US005452552A

United States Patent [19]

Ting

[11] Patent Number: 5,452,552

[45] Date of Patent: Sep. 26, 1995

[54] LEAKPROOF FRAMED PANEL CURTAIN WALL SYSTEM

[76] Inventor: Raymond M. L. Ting, 318 Holiday Dr., Pittsburgh, Pa. 15237

[21] Appl. No.: 33,332

[22] Filed: Mar. 18, 1993

[51] Int. Cl.[6] ..... E04B 2/96

[52] U.S. Cl. ..... 52/235; 52/506.01; 52/506.04

[58] Field of Search ..... 52/235, 506.01, 52/506.04, 490

[56] References Cited

U.S. PATENT DOCUMENTS

| | | | |
|---|---|---|---|
| 4,021,987 | 5/1977 | Schnebel et al. | 52/235 |
| 4,574,546 | 3/1986 | Gartner | 52/235 |
| 4,672,784 | 6/1987 | Pohlar | 52/235 |
| 4,685,263 | 8/1987 | Ting | 52/235 |
| 4,840,004 | 6/1989 | Ting | 52/235 |

*Primary Examiner*—Carl O. Friedman
*Assistant Examiner*—Christopher Todd Kent
*Attorney, Agent, or Firm*—Michael J. Kline; Paul D. Bangor, Jr.

[57] ABSTRACT

This invention relates to an exterior curtain wall system assembled from multiple framed panels. The design utilizes externally framed panel design with concealed water drainage mechanism within pressure equalized wall cavities to eliminate the dependency of the sealing integrity of the shop and/or field applied sealant lines for watertight performance. The design also eliminates the accumulative thermal movement of the wall surface and facilitates the easiness of replacing an individual facing panel.

15 Claims, 5 Drawing Sheets

LEAKPROOF FRAMED PANEL CURTAIN WALL SYSTEM

BACKGROUND OF THE INVENTION

1. Field of the Invention

This invention relates to exterior curtain wall system utilizing multiple framed panels. Each individual framed panel consists of a facing panel supported by four perimeter members. In this type of curtain wall system, there are two typical field formed wall joints, namely, horizontal wall joint and vertical wall joint. These field formed wall joints are the potential sources of water leakage problem. The wall joint designs of this invention eliminate the dependency of sealant line integrity for watertight performance. In addition, this invention allows thermal movement of the facing panel to be unrestrained by the perimeter frame and vice versal. Also this invention allows easy replacement of each individual facing panel. The facing panel material can be glass panel, natural or artificial stone panel, composite honeycomb panel, composite foam panel, or metal plate.

2. Description of the Prior Art

The mechanism of water leakage phenominon can best be described in the following manner. The first step is that the exterior rain water running along the exterior wall surface reaches the sealant lines of the field formed wall joints. The second step is that if the sealant lines are not perfect (i.e. pin holes or small cracks in the sealant lines), the water reached the sealant lines will infiltrate through the pin holes or cracks in the sealant lines under a positive pressure between the exterior air and the interior air. The positive pressure always exists on the windward wall due to the wind forces and is sometimes magnified by the suction type air exchange system of the building. The prior art systems for solving the water leakage problem can be classified into the following four generations.

The first generation of the wall joint design is to seal off the wall joints right along the exterior wall surface using field applied caulking. The facing panel is structurally supported by an interior wall frame system using curable silicone caulking as the structural connection. This type of design is an attempt of making a perfect seal in the field (i.e. no pin hole or hairline crack in the sealant line is allowed). This perfect seal concept requires careful field executions of the following items.

(1) The caulking backer (known as backer rod) must be placed in the proper location to give an adequate and uniform caulking depth.

(2) The caulking bonding surfaces must be free of water, oil, or dirt before the application of caulking (i.e. no erection on a rainy day).

(3) The caulking must be tooled after the application.

It can be easily seen from the above that this perfect seal concept is highly dependent of the field workmanship. In addition, cyclic thermal movements of the facing panel surface induce stress reversals within the sealant causing latent sealant failure due to stress fatigue. Aside from the sealing reliability and durability problems, the caulked wall joints are known to have two aesthetic problems, namely, streaking due to chemical release and dirt collection due to electrical charge. Another drawback of the system is the need of temporary support before the curing of the structural caulking and the associated removal of the temporary support and the patching of the sealant due to the removal of the temporary support.

The second generation of the wall joint design utilized the concept of controlled water leakage. The first design feature is to use interior perimeter aluminum extrusion members structurally connected to and sealed to the facing panel in the shop to form interlocking tongue-and-groove horizontal and vertical panel side joints. The tongue-and-groove joints are hidden behind but close to the facing panel and are sealed with nonbonding gasket material to allow free thermal movements of the panel surface without causing sealant stresses. However, the nonbonding contacting surface of the gasket represents a continuous hairline crack which will allow water infiltration through the sealant line under positive differential pressure, therefore, it requires a second design feature to control the water leaked through the gasket line. The second design feature is to create a horizontal gutter (known as internal gutter) behind the gasket line within the depth of the perimeter aluminum extrusion to collect the water leaked through the gasket line and to provide drainage holes from the bottom of the internal gutter to the exterior horizontal panel joint such that the water collected within the internal gutter can be drained to the outside after the positive pressure differential has been subsided. In addition, it is required to splice and to seal the horizontal internal gutter across the vertical wall joint, to seal off the holes at four corner intersections, and to seal between the horizontal and vertical gasket lines (known as marriage seal) in the field to complete the system. Again, these three field sealing operations must rely on careful workmanship in the field. In addition, these field applied sealants are subjected to stresses due to thermal movements of the wall panel surface. Another drawback of the design is that the exposed drainage holes will allow the water to infiltrate freely into the internal gutter under positive pressure, therefore, substantial water buildup in the internal gutter is expected even in there is no water leakage in the gasket line. This high water buildup in the internal gutter necessitates a high gutter leg design and increases the risk of water leakage at the gutter splice joint. Another drawback of the design is that the potential leakage source of the gutter splice is hidden behind the plate, thus, repair can only be done from the interior side which usually involves costly interior restoration. Additional aesthetic problem is the water stain on the panel surface below the drainage holes.

The third generation of the wall joint design is that the facing panel is structurally sandwiched between an exterior flange and an interior flange of the perimeter aluminum extrusion and sealed in between. To reduce the probability of water leakage, three different design methods have been used in the industry. The first design method is to completely seal the gap between the exterior flange and the facing panel using silicone caulking. This method has the drawbacks of the first generation design except the need of temporary support. The second design method is to use gasket with pressure applied by the force of screw known as "pressure bar system" to seal the gap between the exterior flange and the facing panel. However, the nonbonding contacting surface of the gasket represents a continuous hairline crack which will allow water infiltration through the sealant line under positive differential pressure, therefore, it requires to use the seating surface of the facing panel to act as an internal gutter with exposed outward drainage holes. In this arrangement, water may overflow the gutter and seep through the interior sealant line under high pressure differential. The third design method is to create an internal horizontal gutter and down spout drainage system in combination with the first or the second method. The third method has a higher rate of success in preventing water leakage. However, it costs much more. In addition, the required thermal expansion joints of the exposed aluminum members are difficult to arrange and to maintain sealing integrity.

The fourth generation design which is my prior invention (U.S. Pat. No. 4,840,004) utilizes interior perimeter frame to support the facing panel and to create a water drainage system within a pressure equalized wall cavity eliminating the dependency of field workmanship for water tight performance. However, due to the interior frame arrangement, differential thermal movement between the facing panel and the interior frame creates stresses within the shop applied sealant line which may result in shop applied sealant line failure leading to water leakage problem. Therefore, even though this design represents a major improvement of eliminating the dependency of field workmanship for watertight performance, it still has to depend on the long term integrity of the shop applied sealant line. In addition, due to the structural connection between the facing panel and the interior frame, replacing an individual damaged facing panel is extremely difficult.

In summary, all the prior art design methods must rely on long term sealing integrity of the field and/or shop applied sealant line. It is obvious that consistent perfect field or shop applied sealant line is practically unachievable. Therefore, the probability of water leakage problem continues to exist.

SUMMARY OF THE INVENTION

The objectives of this invention include the following items.

1. To eliminate the dependency of the sealing integrity of the shop and/or field applied sealant lines for the watertight performance.

2. To prevent the interference between the facing panel and the perimeter frame due to differential thermal movements.

3. To allow easy replacement of an individual facing panel.

4. To use the interior face of the assembled wall panel as the interior finished wall surface.

5. To eliminate the accumulative thermal movement of the wall surface.

It will become obvious from the description of the preferred embodiments that the objectives of this invention are accomplished by the design features.

DESCRIPTION OF THE PREFERRED EMBODIMENTS

Figure 1:
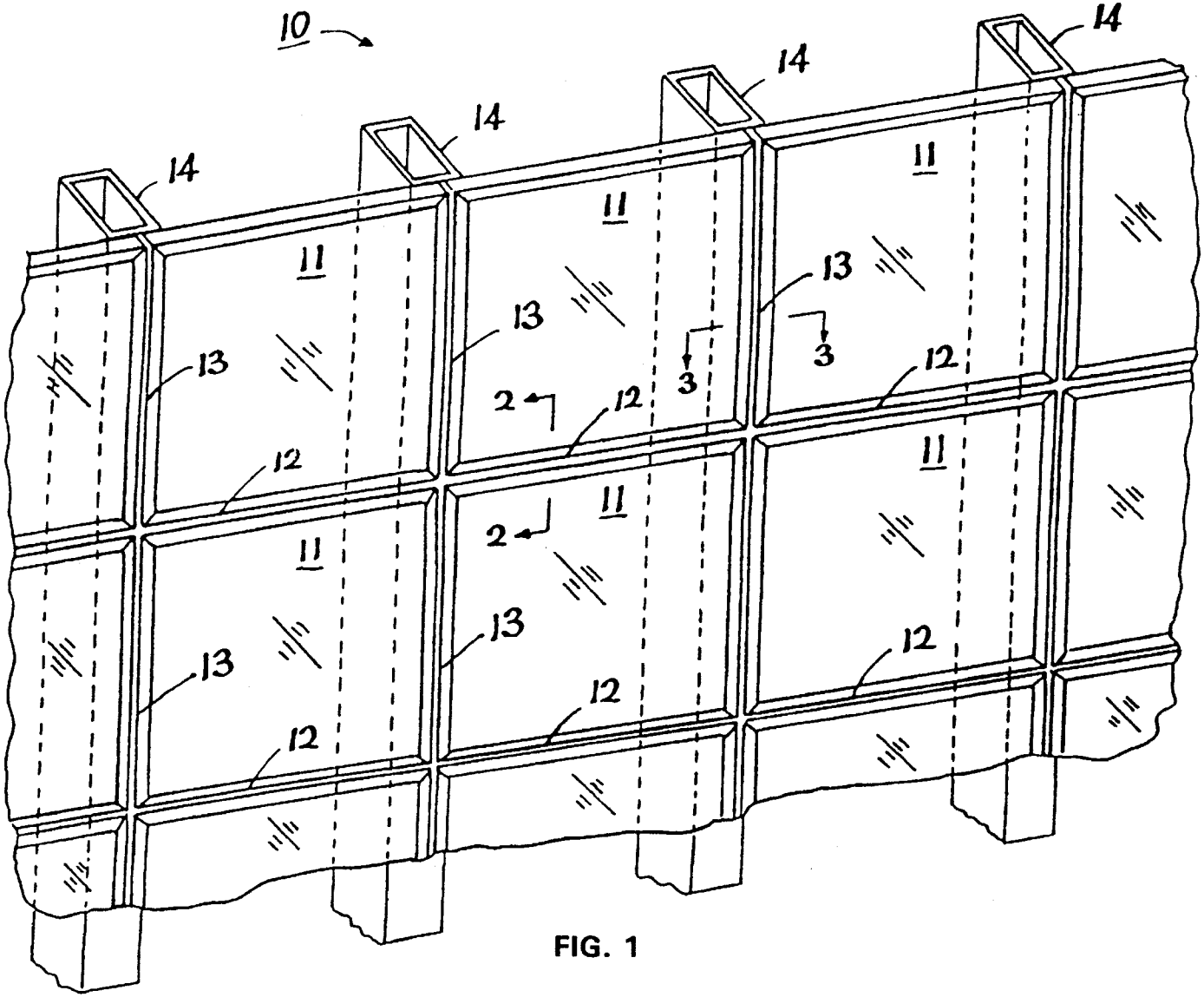
FIG. 1 is an isometric view illustrating a portion of the curtain wall system of the invention using glass panel as an example.

FIG. 1 illustrates an exterior curtain wall structure 10 consisting of spaced apart vertical mullions 14, multiple framed panels 11. Two types of wall joints are formed in the field, namely, horizontal wall joints 12 and vertical wall joint 13.

Figure 2:
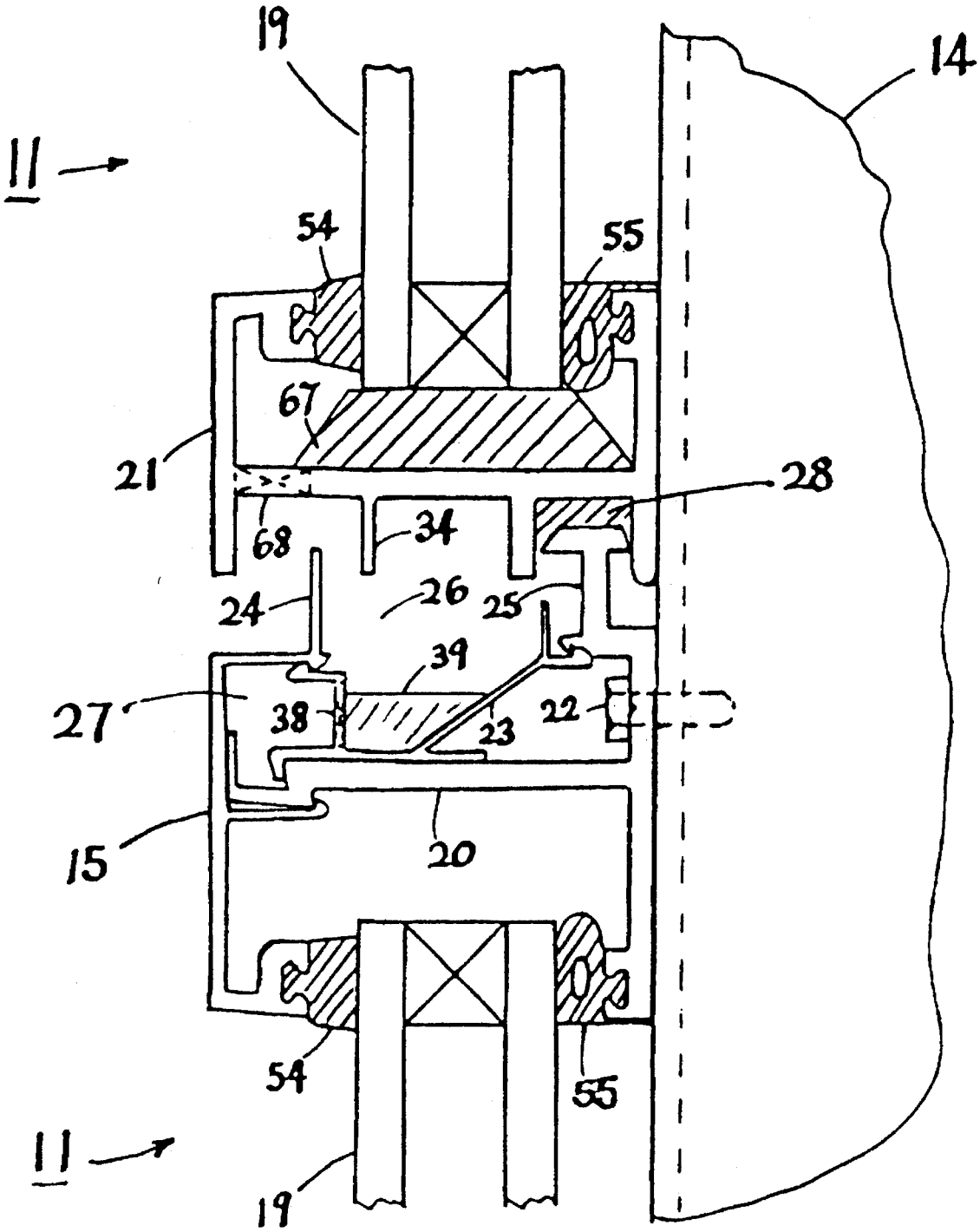
FIG. 2 is a typical fragmentary cross-sectional view taken along line 2—2 of FIG. 1 showing the horizontal wall joint of the invention using glass panel as an example.

FIG. 2 shows a typical fragmentary cross-section of the horizontal wall joint 12 taken along line 2—2 of FIG. 1 where glass panel is used. Each framed panel 11 has a glass panel 19 supported by a top window head member 20 usually made of aluminum extrusion, and a bottom window sill member 21 usually made of aluminum extrusion. The head member 20 is secured to the face of mullion 14 using screws 22. The head member 20 is designed to have an inner structural male spline 25 and to adapt a gutter member 23 and a head cover 15 in a snap-on fashion. The gutter member 23 is provided with end dams 39 and drainage holes 38. The head cover 15 is designed to have an integral horizontal rain screen member 24 and together with head member 20 and gutter member 23 to form a hidden horizontal drainage tunnel 27. The drainage tunnel 27 is open at both ends where vertical joint is formed. The sill member 21 has an inner structural groove with sealing material 28 to cause structural engagement with the spline 25 of the window panel below. The weight of the glass panel 19 is supported by the sill member 21 with the protection of the setting blocks 67. Drainage holes 68 and a downwardly extended leg 34 are provided in the sill member 21. The glass panel 19 is secured within the aluminum frame using the exterior gasket 54 and the interior gasket 55. It can be seen from the construction that most of the wind driven water will be repelled by the rain screen member 24 and spilled over water will be guided into the external gutter 26 by the leg 34. Since both the external gutter 26 and the drainage tunnel 27 are pressure equalized, the drainage of water from the external gutter 26 into the drainage tunnel 27 through the drainage holes 38 will be instantaneous and there will be no water buildup in the external gutter 26. It becomes obvious that it is impossible for the exterior water to get to the interior gasket 55 or the field formed horizontal sealed joint using gasket 28. Any water seeped through the exterior gasket 54 will drain to the outside through the drainage holes 68. The drainage holes 68 also help to equalize the pressure in the frame cavity surrounding the glass panel 19. The installation procedures include the following steps: (1) putting the framed panel 11 in position to cause bottom joint engagement; (2) securing the head member 20 to mullion 14; (3) snap-on gutter member 23; (4) snap-on the head cover 15.

Figure 2A:
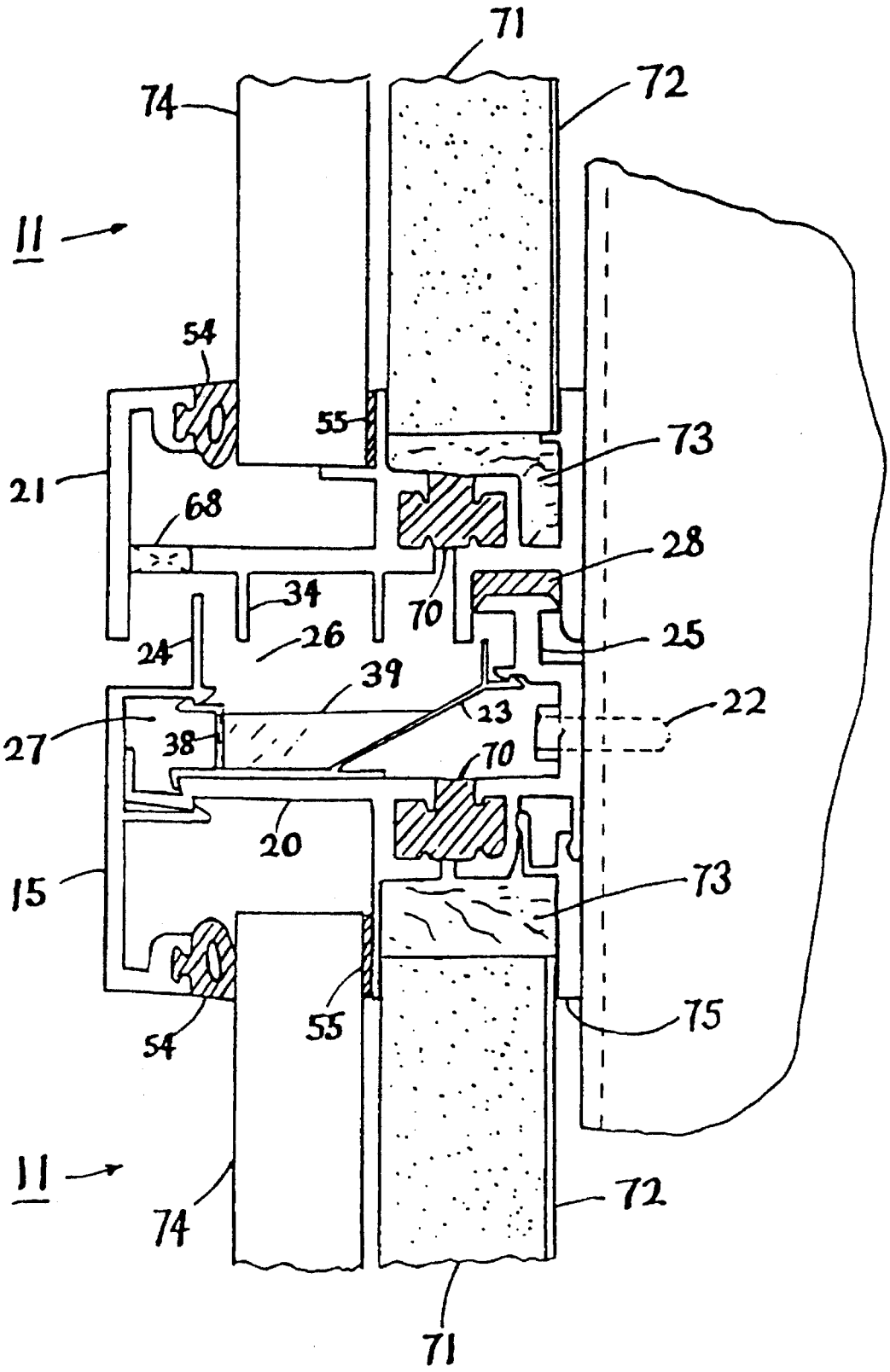
FIG. 2*a* is a possible variation of FIG. 2 where built-in insulation board and opaque facing panel are used.

FIG. 2*a* is a possible variation of FIG. 2. The glass panel 19 is replaced by an opaque panel 74 which can be natural stone, honeycomb panel, composite foam panel, etc.. The insulation board 71 with an interior skin 72 can be shop assembled into the framed panel 11 to provide thermal insulation value. Structural thermal break material 70 is provided within the frame members 20 and 21 using pour-and-debridge process. Loosely packed glass fiber insulation 73 can be used to further improve the thermal efficiency. An interior snap-on cover member 75 can be used to facilitate the replacement of the insulation board 71 from inside. The skin 72 can be used as the finished interior surface with many variations such as painted metal skin, painted drywall, wooden panel, or drywall with wall paper. This will eliminate the need of building a separate interior finished wall resulting in significant savings of time and money.

Figure 3:
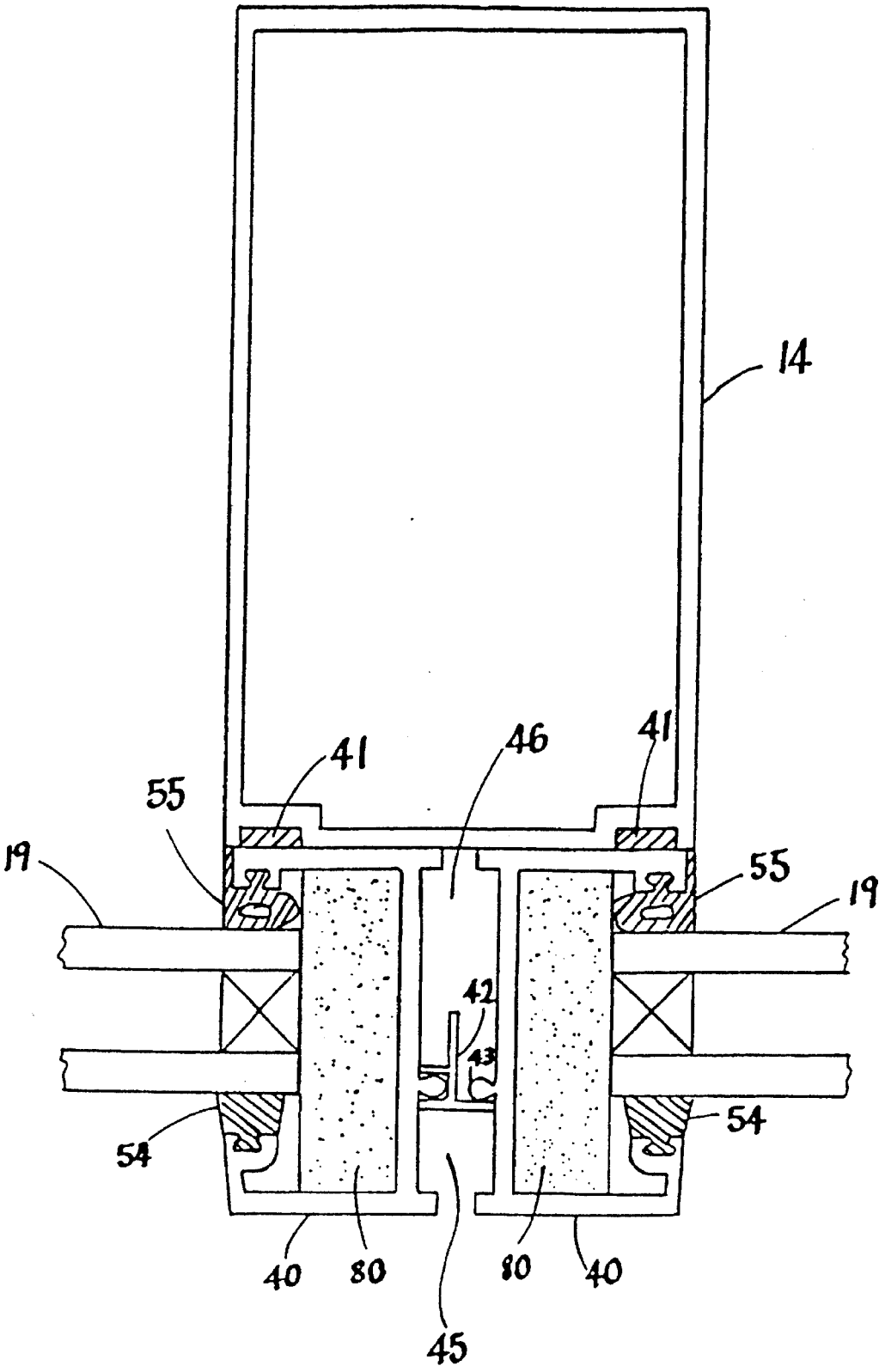
FIG. 3 is a typical fragmentary cross-sectional view taken along line 3—3 of FIG. 1 showing the vertical wall joint of the invention using glass panel as an example.

FIG. 3 shows a typical fragmentary cross-section of the vertical window joint taken along line 3—3 of FIG. 1. The jamb members 40 are profiled to miter-match with the top perimeter member 20 and the bottom perimeter member 21 at the corners of the window frame. Sealant 41 contained in a cavity on the face of the mullion 14 forms the vertically sealed line and it can be either shop applied or field applied. The vertical rain screen member 42 is field installed continuously across the horizontal panel joint 12 by snapping into engagement with the holding rib 43 of member 40 on one side. The material for member 42 should be flexible such that it will not be damaged by thermal movement of the exterior frame. Gasket type of material would be suitable for member 42. The outer vertical cavities 45 serve as the drainage down-spout. The inner vertical cavity 46 is interconnected with the horizontal open cavities 26 (shown on FIG. 2) at each horizontal window joint and thus is pressure equalized to the exterior air. Due to the fact of pressure equalized cavity 46, it becomes obvious that the exterior rain water will be confined to the front of the vertical joint flowing downwardly within cavity 45. Therefore, it is impossible for the exterior rain water to reach the vertical sealant 41 which can be a shop installed sponge gasket. Anti-walk blocks 80 can be installed near the top of the glass panel 19. The pocket occupied by the block 80 should be deep enough to allow the replacement of the glass panel 19 without disassembling the framed panel. To replace the glass panel 19, the following steps are required: (1) unzip the gasket 54; (2) un-snap member 15; (3) take out blocks 80; (4) take out the old glass panel 19; (5) place the new glass panel 19; (6) place blocks 80; (7) snap on head cover 15; (8) place gasket 54 and caulk the corners. It can be easily seen from the details that differential thermal movement between the facing panel and the perimeter frame can be easily absorbed within the frame cavity. It can also be seen from the details that each field formed horizontal or vertical wall joint represents a thermal expansion joint, therefore, the thermal movements of the framed panel will not accumulate and grow no matter how tall or how wide the building is.

Figure 3A:
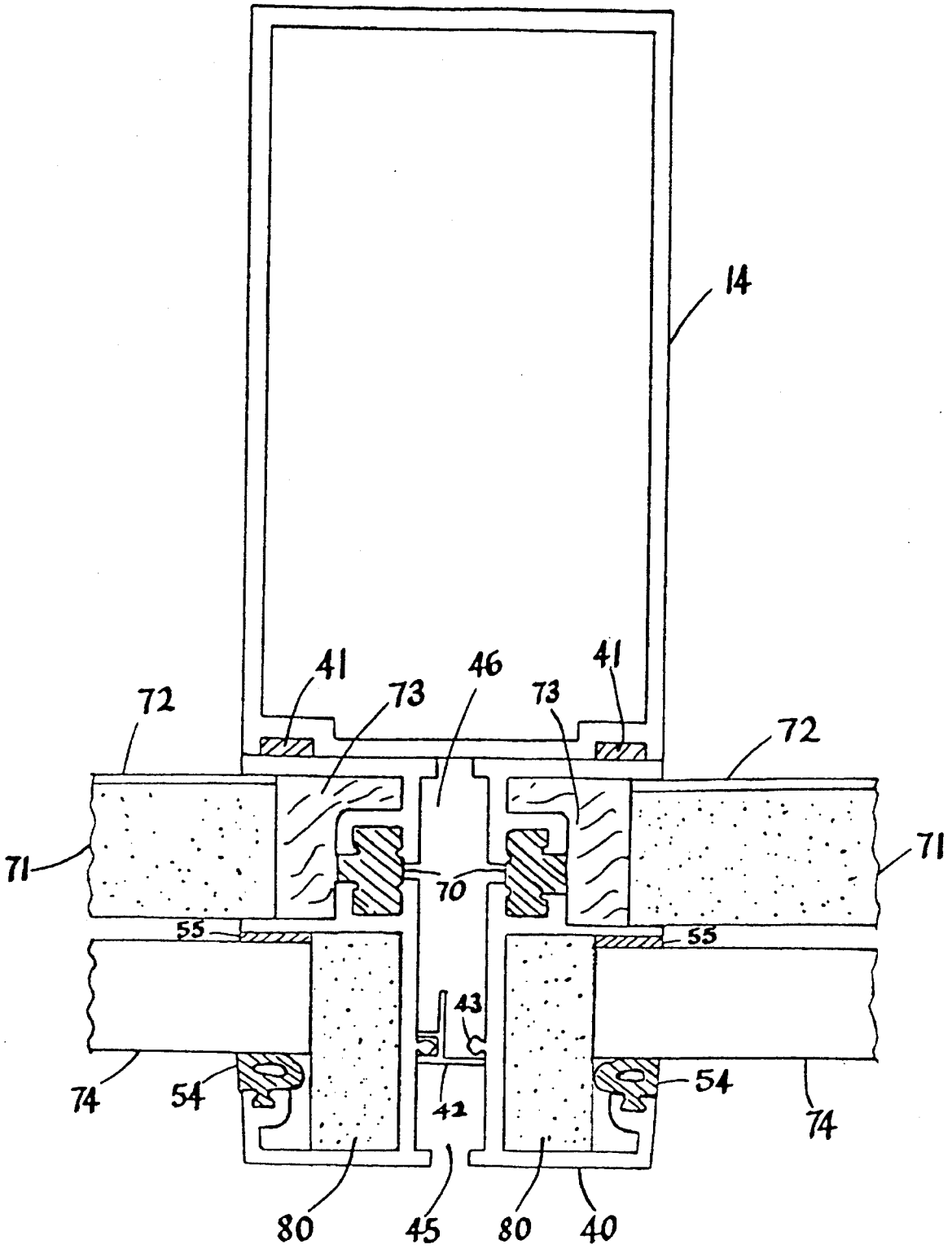
FIG. 3*a* is a possible variation of FIG. 3 where built-in insulation board and opaque facing panel are used.

FIG. 3*a* is a possible variation of FIG. 3 where opaque facing panel 74 instead of the glass panel 19 is used and the insulation board 71 with interior skin 72 is added. The details are similar to those explained in FIG. 2*a*.

From the above descriptions, it is obvious that all the five objectives of this invention are accomplished.

While I have illustrated and described several embodiments of my invention, it will be understood that these are by way of illustration only and that various changes and modifications may be contemplated in my invention and within the scope of the following claims.

I claim:

1. A curtain wall system formed from individual framed panels and supported on spaced apart vertical mullions, each said framed panel comprising a facing panel forming the exterior surface and a perimeter frame including four perimeter members, namely, a top horizontal member, a bottom horizontal member, and two vertical side members, said perimeter members having inner surfaces;

each said perimeter member having an inward exterior flange and an inward interior flange connected in-between by a web, said facing panel being interposed between said exterior and said interior flanges such that a frame cavity within said perimeter frame is created and bordered by the edge of said facing panel, said web, said exterior flange, and said interior flange;

an exterior and interior sealing means being provided between said facing panel and said exterior and interior flanges of said perimeter frame, said framed panels being secured to said mullions and erected from bottom to top to form horizontal wall joints and side by side to form vertical wall joints;

said top horizontal member comprising an inner structural male joint spline, a horizontal rain screen member, a snap-on horizontal gutter member with end dams, a hidden open ended horizontal drainage tunnel, drainage holes being provided between the bottom of said gutter member and said drainage tunnel;

said bottom horizontal member comprising an inner structural female joint designed to cause slidable structural engagement with said inner male joint spline of said top horizontal member of the installed panel below, an outer female joint to loosely contain the top part of said horizontal rain screen member of said top member of the installed framed panel below, drainage holes being provided on said web, and setting blocks being provided to support the weight of said facing panel and to create said frame cavity;

inner surfaces of said side member comprising an inner surface being flush with the inner surfaces of said top and bottom horizontal members to cause sealing with the frontal face of said mullion, an outwardly extended rib to cause snap-on engagement with a separate vertical rain screen member and is located such that the installed vertical rain screen member will be behind said horizontal rain screen member.

2. The facing panel of claim 1 is a glass panel.

3. The facing panel of claim 1 is a composite honeycomb panel.

4. The facing panel of claim 1 is a composite foam panel.

5. The facing panel of claim 1 is a natural stone.

6. The top member of claim 1 comprising an inner structural member containing said inner structural male joint spline and said inner flange, a snap-on gutter member, and a snap-on cover member containing said horizontal rain screen member and said outer flange.

7. The perimeter frame of claim 1 being made of aluminum extrusions.

8. The vertical rain screen member of claim 1 being made of neoprene material.

9. The perimeter frame of claim 1 being thermally broken using pour-and-debridge process.

10. The perimeter frame of claim 1 being inwardly extended to create an additional inner space to house an insulation board.

11. The insulation board of claim 10 having a finished interior skin.

12. The finished interior skin of claim 11 is a painted metal skin.

13. The finished interior skin of claim 11 is a stainless steel skin.

14. The finished interior skin of claim 11 is a wooden panel.

15. The finished interior skin of claim 11 is a drywall panel.

* * * * *

UNITED STATES PATENT AND TRADEMARK OFFICE

CERTIFICATE OF CORRECTION

PATENT NO. : 5,452,552

DATED : September 26, 1995

INVENTOR(S) : Raymond M. L. Ting

It is certified that error appears in the above-identified patent and that said Letters Patent is hereby corrected as shown below:

On the title page, Item [54] and Column 1, LINES 1-3 the title should read as follows
-- FRAMED PANEL CURTAIN WALL SYSTEM--.

Signed and Sealed this

Sixteenth Day of April, 1996

Bruce Lehman

*Attest:*

BRUCE LEHMAN

*Attesting Officer*

*Commissioner of Patents and Trademarks*